US005575243A

United States Patent [19]

Vetterick

[11] Patent Number: 5,575,243

[45] Date of Patent: Nov. 19, 1996

[54] LOW $NO_x$ INTEGRATED BOILER-BURNER APPARATUS

[75] Inventor: Richard C. Vetterick, Akron, Ohio

[73] Assignee: The Babcock & Wilcox Company, New Orleans, La.

[21] Appl. No.: 347,613

[22] Filed: Nov. 30, 1994

[51] Int. Cl.[6] ..... F22B 15/00

[52] U.S. Cl. ..... 122/235.11; 122/13.1; 122/235.13; 122/367.1

[58] Field of Search ..... 122/6 R, 8, 13.1, 122/235.11, 235.13, 235.15, 367.1

[56] References Cited

U.S. PATENT DOCUMENTS

| | | | |
|---|---|---|---|
| 2,653,447 | 9/1953 | Heller | 60/49 |
| 3,760,776 | 9/1973 | Durrant | 122/459 |
| 3,781,162 | 12/1973 | Rudd et al. | 431/115 |
| 3,973,523 | 8/1976 | Keller et al. | 122/510 |
| 4,085,708 | 4/1978 | Ashdown | 122/7 B |
| 4,462,795 | 7/1984 | Vosper et al. | 432/29 |
| 4,767,319 | 8/1988 | Vosper | 431/350 |

OTHER PUBLICATIONS

*Steam: its generation and use,* 39th Edition, Copyright ©1978 by The Babcock & Wilcox Company, pp. 25–5 to 25–10; and 27–10.

*Steam: its generation and use,* 40th Edition, Copyright ©1992 by The Babcock & Wilcox Company, pp. 25–8, 31–1 to 31–4; and 31–8.

Piwetz, Brown & Root; Aleman and Smith, Babcock & Wilcox, "A unique approach to a combined cycle unit". Technical paper No. BR–1067, presented to American Power Conference, Chicago, Ill., Apr. 20–22, 1976. Entire paper.

The Babcock & Wilcox Company brochure, "The Babcock & Wilcox Stirling Power Boiler–SPB. The most versatile steam generator available." Data circa 1975. Entire paper.

The Babcock & Wilcox Company brochure, "The Babcock & Wilcox PFT boiler. Dependable, high–pressure steam from tough liquid fuels". Data circa 1975. Entire paper.

The Babcock & Wilcox Company brochure, "The Babcock & Wilcox PFI boiler. Dependable, low–cost steam for liquid and gaseous fuel firing". Date circa 1975. Entire paper.

*Primary Examiner*—Henry A. Bennett
*Assistant Examiner*—Siddharth Ouri
*Attorney, Agent, or Firm*—Robert J. Edwards; Eric Marich

[57] ABSTRACT

A low $NO_x$, integrated boiler-burner apparatus includes a horizontally fired, factory assembled package boiler having an inlet plenum and a furnace space is provided with a multi-nozzle burner (MNB) array including a plurality of vertically and horizontally spaced burner nozzles located at an entrance to the furnace space for supplying fuel for combustion into the furnace space. The MNB array distributes the heat of the combustion exhaust gases across the furnace space for minimizing $NO_x$ formation. One or more chill tube assemblies are located within the furnace space just downstream of the MNB array for rapidly reducing the temperature of the combustion exhaust gases. Alternatively, laterally perforated internal air duct assemblies can also be provided within the furnace space alone or in combination with the chill tube assemblies in various arrangements to provide staged air for completing combustion in the furnace space. Exhaust gases from an exhaust flue of the package boiler can also be recirculated back to the inlet plenum for re-exposing the exhaust gases to the combustion process.

31 Claims, 13 Drawing Sheets

LOW $NO_X$ INTEGRATED BOILER-BURNER APPARATUS

FIELD AND BACKGROUND OF THE INVENTION

The present invention relates, in general, to factory assembled boilers for steam and/or electric power generation, also referred to as package boilers, and particularly to a new package boiler assembly having a low $NO_x$ integrated boiler-burner apparatus which employs a multiple nozzle burner array in its inlet windbox, and other features which improve its operation.

Multiple nozzle array burners (often referred to as duct burners) are known as are package boilers which are designed for factory assembly. See, for example U.S. Pat. Nos. 4,462,795 and 3,173,523. A particularly successful package boiler design is known as the FM Package Boiler manufactured by The Babcock & Wilcox Company and disclosed in the publication *Steam: its generation and use,* 40th Edition page 25–8. Other types of package boilers include what are known as "F" type boilers, particularly the PFI (Power for Industry) and PFT (Power for Turbine) types described in *Steam: its generation and use,* 39th Edition, Chapter 25, pages 25–8 and 25–9. Also known are the "Three Drum Waste Heat Boilers" shown on page 27–10, FIG. 10, of *Steam: its generation and use,* 39th Edition, and on page 31–8 of *Steam: its generation and use,* 40th Edition. This latter type of boiler is also known as an "FO" type, and in the industry as simply an "O" type boiler.

The use of supplemental cooling tubes in the inlet area of a boiler furnace is also known. See for example, U.S. Pat. No. 2,653,447. Additionally, water cooled surface in the form of division walls or wing walls have been supplied on many boilers to increase heat absorption and reduce furnace temperatures. The use of staging air for $NO_x$ reduction through sidewall ports in package boilers is also known.

The use of fins in an inlet duct with burners is also disclosed in U.S. Pat. No. 3,781,162. Also see U.S. Pat. No. 4,767,319 for various baffles and control surfaces to help distribute heat in a duct burner arrangement.

SUMMARY OF THE INVENTION

One aspect of the present invention is drawn to a low $NO_x$, integrated boiler-burner apparatus comprising the combination of a horizontally fired, factory assembled package boiler having an inlet plenum and a furnace space spanned by a multi-nozzle burner (MNB) array, and one or more vertically extending chill tube assemblies in the furnace space downstream of the MNB array, positioned at a location for rapidly cooling the combustion gases to minimize $NO_x$ formation. A specific positioning and extent of the chill tube assemblies to within approximately ⅓ of the horizontal furnace depth, the remaining furnace being left substantially free of obstructions, allows final and complete burn-out of the carbon monoxide before the flue gases are quenched by the boiler generating tubes.

Another aspect of the invention is drawn to the use of an air foil construction for reduced flue gas side pressure drop, the burner nozzles of the multi-nozzle burner (MNB) array being supported at the trailing edge of the air foils. Further details of the invention include centering each column of burner nozzles in the MNB array between adjacent rows of horizontally spaced, vertically extending chill tube assemblies. This reduces flame impingement on the chill tube assemblies while at the same time maximizing the cooling effect of the chill tube assemblies surfaces on the combustion gases.

In another feature of the invention, air drawn from the plenum can also be supplied to one or more vertically extending 10 and perforated internal duct assemblies downstream of, interspersed with, or combined with the chill tubes for use when the boiler is operated with a fuel rich mixture at the multi-nozzle burner (MNB) array, final combustion taking place at or downstream of the internal duct assemblies.

Further additional features which are encompassed by the invention are a gas recirculation duct extending from the area of the stack at the outlet of the package boiler, for conveying flue gases back to the inlet windbox or plenum of the package boiler for the purpose of diluting the oxygen levels provided to the combustion process.

All of the above features can be combined together in various combinations, with or without use of other features.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which preferred embodiments of the invention are illustrated.

DESCRIPTION OF THE PREFERRED EMBODIMENTS

Figure 1:
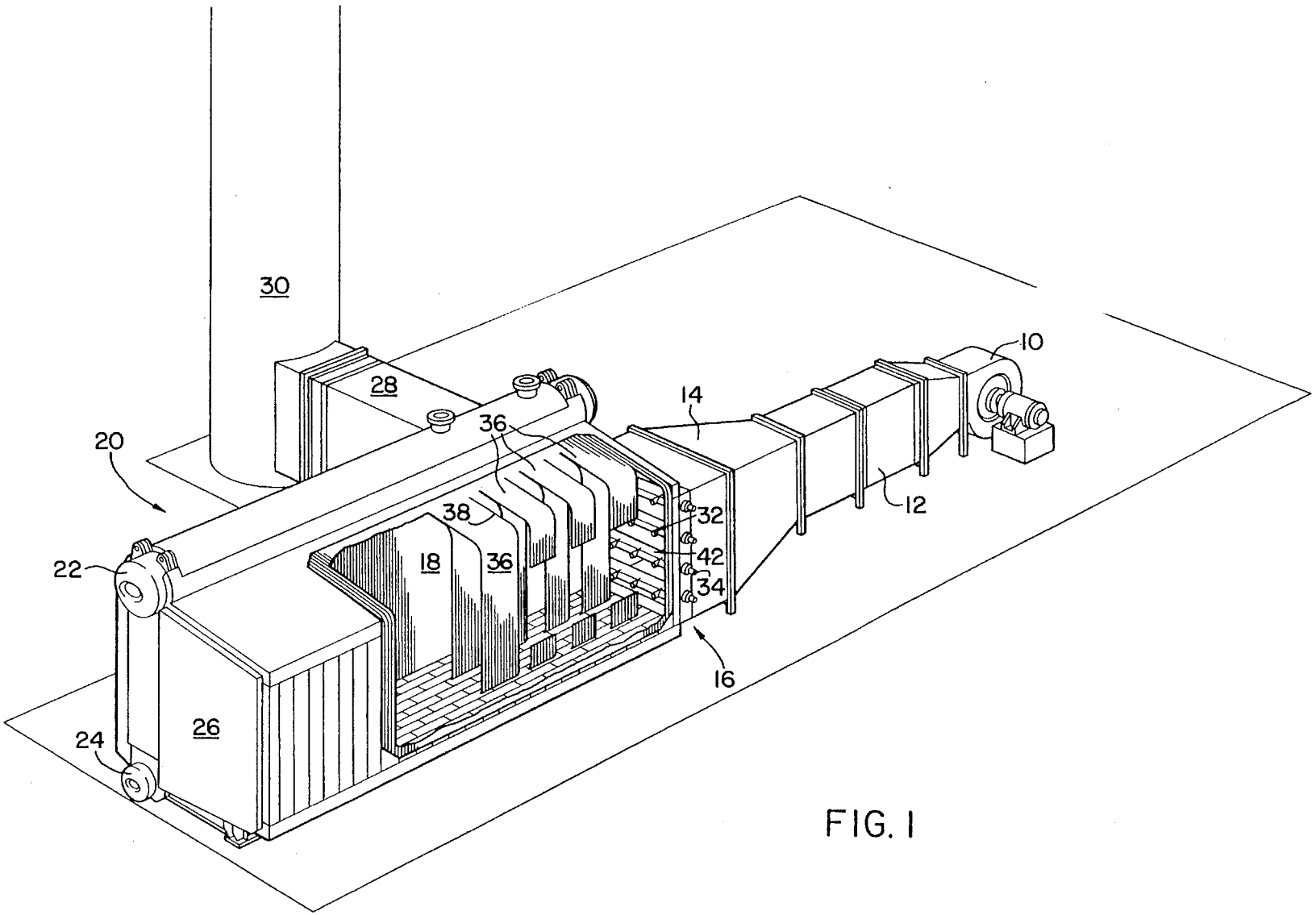
FIG. 1 is a perspective view, partly in section, of a first embodiment of the low $NO_x$, integrated boiler-burner apparatus according to the present invention wherein one or more chill tube assemblies are positioned in the furnace space of the boiler.

Referring to the drawings generally, wherein like numerals represent the same or functionally similar elements throughout the several drawings, and to FIG. 1 in particular, a first embodiment of the invention is shown in FIG. 1 and comprises a horizontally fired, factory assembled package boiler generally designated 20 having a furnace space 18 for receiving flames from a multi-nozzle burner (MNB) array 16. MNB array 16 is located at an entrance to furnace space 18, preferably in an inlet windbox or plenum 14 connected to inlet duct 12 of the package boiler 20. The MNB array 16 provides the fuel for combustion into the furnace space 18 of package boiler 20. Package boiler 20 is of a known design which includes a back wall 26 at which the combustion exhaust gases moving horizontally along furnace space 18, turn through 180° and then move horizontally through a bank of boiler tubes (not shown) which are fluidically connected between upper and lower steam drums 22, 24, respectively. The combustion exhaust gases subsequently pass through exhaust gas flue 28 and leave the unit through a stack 30. Forced draft fan means 10 provides the necessary air for combustion at desired flow rates and static pressures to overcome all resistances in the system and exhaust the combustion gases to/through the stack 30.

MNB array 16 preferably comprises a plurality of vertically and horizontally spaced burner nozzles 32 which are carried on the trailing edges of a plurality of air foils 42. Each burner nozzle 32 receives fuel from a fuel line 34 extending into its respective air foil. The burner nozzles 32 are distributed in rows and columns on air foils 42 and are provided so that the rows and columns of burner nozzles 32 are spaced across the width and height of the entrance to furnace space 18 to evenly distribute the fuel for combustion into the furnace space 18. Preferably, a plurality of horizontally extending and vertically spaced air foils 42 are provided, extending across the entrance to the furnace space 18, each air foil 42 carrying a horizontal row of burner nozzles 32. Alternatively, a plurality of vertically extending and horizontally spaced air foils 42 may be provided, extending across the entrance to the furnace space 18, each air foil 42 carrying a vertical column of burner nozzles 32.

The low $NO_x$, integrated boiler-burner apparatus of FIG. 1 is further outfitted with one or more vertically extending, horizontally spaced chill tube sections or assemblies 36 within the furnace space 18. Assemblies 36 are comprised of boiler tubes 38 which are fluidically connected between upper and lower steam drums 22, 24 of package boiler 20 for immediately absorbing heat from the burner flames. The number of the tubes 38, and their diameter, spacing and materials are selected using well-known fluid flow and heat transfer relationships to achieve a desired water/steam side pressure drop and a desired heat absorption from the flue gas to minimize $NO_x$ production due to the combustion process. Preferably, each chill tube assembly 36 comprises a plurality of tubes 38 arranged in a single row that extends parallel with the combustion exhaust gas flow through the furnace space 18. One or more chill tube assemblies 36 may be provided, arranged adjacent to each other across the width of the furnace space 18. As shown in FIG. 1, the one or more chill tube assemblies 36 may also be provided in one or more rows, with two or more chill tube assemblies 36 in each row. FIG. 1 shows four (4) such rows, with a pair of chill tube assemblies 36 in each row. Advantageously, the rows and columns of burner nozzles 32 are positioned such that their flames are centered between adjacent chill tube assemblies 36, which are immediately downstream of the MNB array 16. This maximizes heat transfer between the combustion exhaust gases and the chill tube assemblies 36, while minimizing flame impingement on the tubes 38. This also has the effect of quickly absorbing the heat from the combustion exhaust gases resulting in a flue gas temperature level below which $NO_x$ formation is not a problem.

Figure 2:
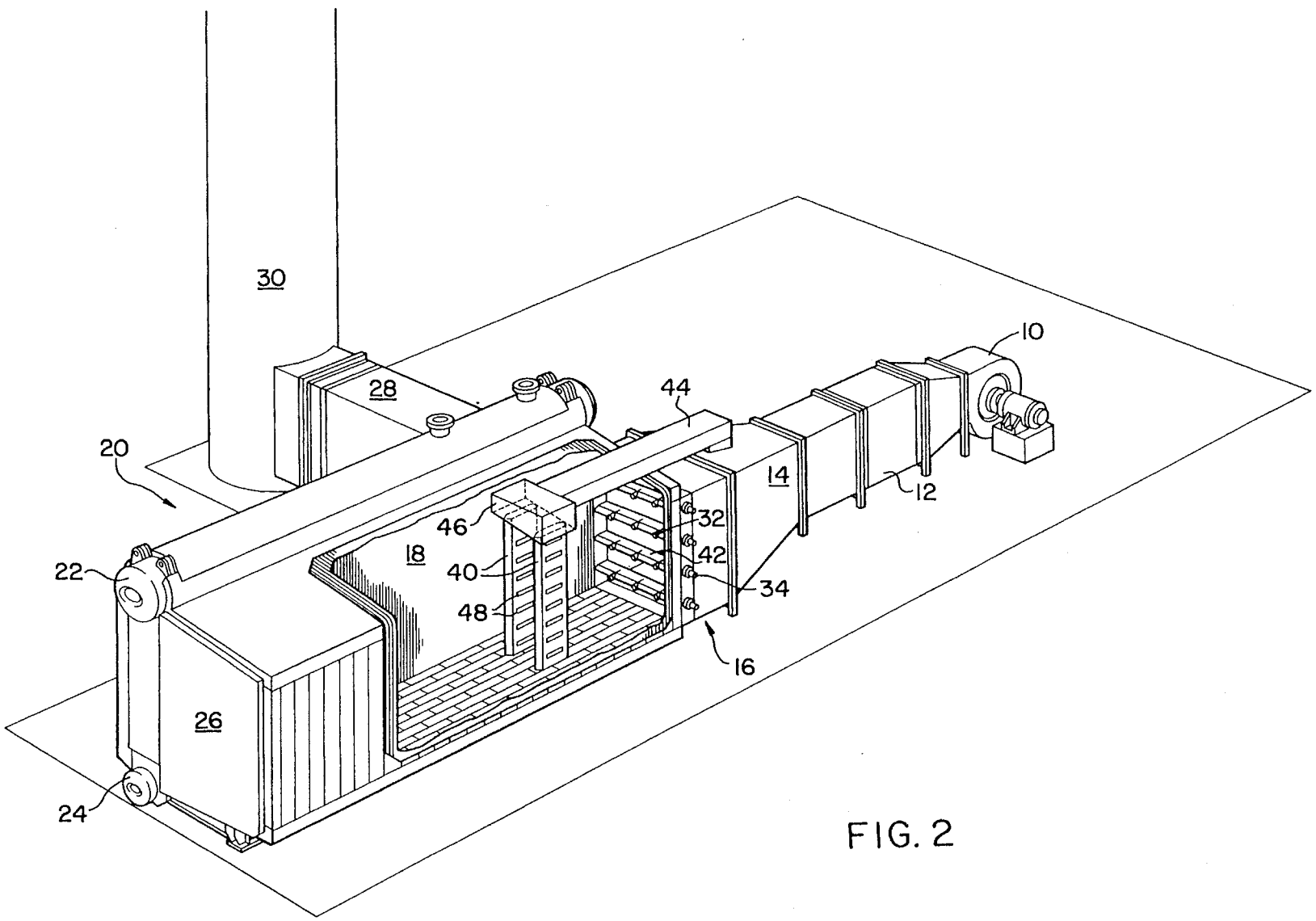
FIG. 2 is a perspective view, partly in section, of a second embodiment of the low $NO_x$, integrated boiler-burner apparatus wherein one or more internal air duct assemblies are positioned in the furnace space of the boiler.

FIG. 2 illustrates a second embodiment of the present invention, wherein one or more vertically extending, laterally perforated, and horizontally spaced internal air duct assemblies 40 are positioned within the furnace space 18. Internal air duct assemblies 40 are connected to plenum 14 by means of air staging duct 44 and air duct plenum 46, to provide staging air into the furnace space 18, beyond the MNB array 16. Each air duct assembly 40 is provided with a plurality of apertures or slots 48 for discharging staging air into the furnace space 18. Suitable dampers and flow measurement devices (not shown) would be provided in air staging duct 44 and/or plenum 46 for control and measurement. The staging air discharged via internal air duct assemblies 40 minimizes peak combustion temperatures which will minimize $NO_x$ formation, by restricting the combustion heat release rate, while completing the final combustion in the furnace space 18 downstream. Advantageously, the air duct assemblies 40 are positioned only a portion of the distance into the furnace space 18 from its entrance, approximately ⅓ to ¾ of the furnace depth. The remaining furnace space 18 downstream is left substantially free of obstructions to allow for final complete burnout of any carbon monoxide before the combustion exhaust gas is quenched by the boiler generating tubes (not shown), after the exhaust gases turn 180° at the back wall 26 in the horizontally fired package boiler 20.

Figure 3:
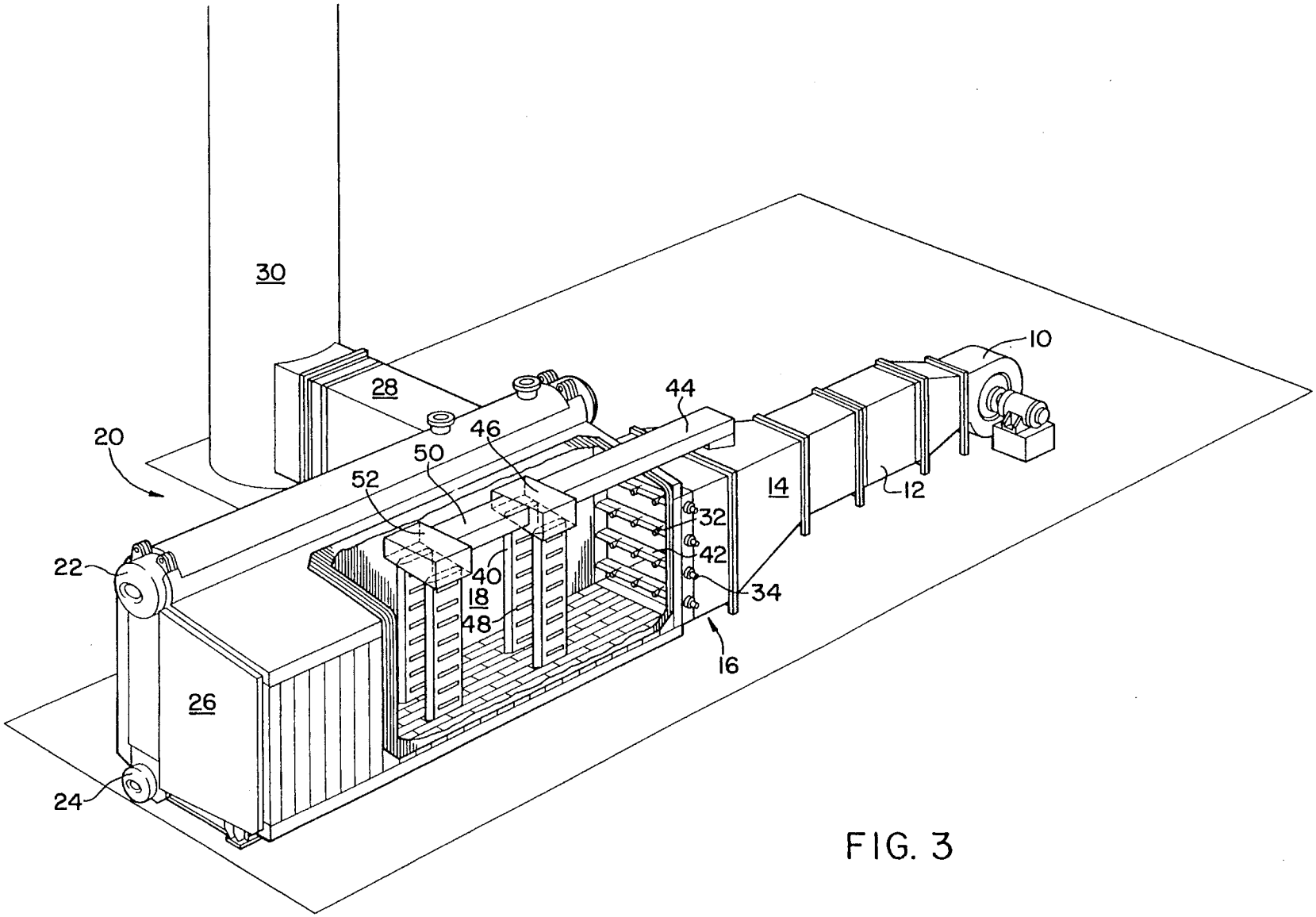
FIG. 3 is a perspective view, partly in section, of a third embodiment of the low $NO_x$, integrated boiler-burner apparatus showing an alternative arrangement wherein one or more internal air duct assemblies are positioned at upstream and downstream locations (with respect to a flow of gases through the apparatus) in the furnace space of the boiler.

Certain package boiler 20 applications may require multiple air staging introduction points in the furnace space 18 to achieve desired combustion temperature and heat release profiles for efficient low $NO_x$ operation. Accordingly, and as shown in FIG. 3, in a third embodiment of the invention one or more internal air duct assemblies 40 may be provided, positioned at upstream and downstream locations (with respect to a flow of gases through the apparatus) within the furnace space 18 of package boiler 20. A second, interconnecting air staging duct 50 and a second, air duct plenum 52 would be provided for the downstream internal air duct assemblies 40. Again, suitable dampers and air flow measurement devices (not shown) would be provided for the downstream internal air duct assemblies 40.

Figure 4:
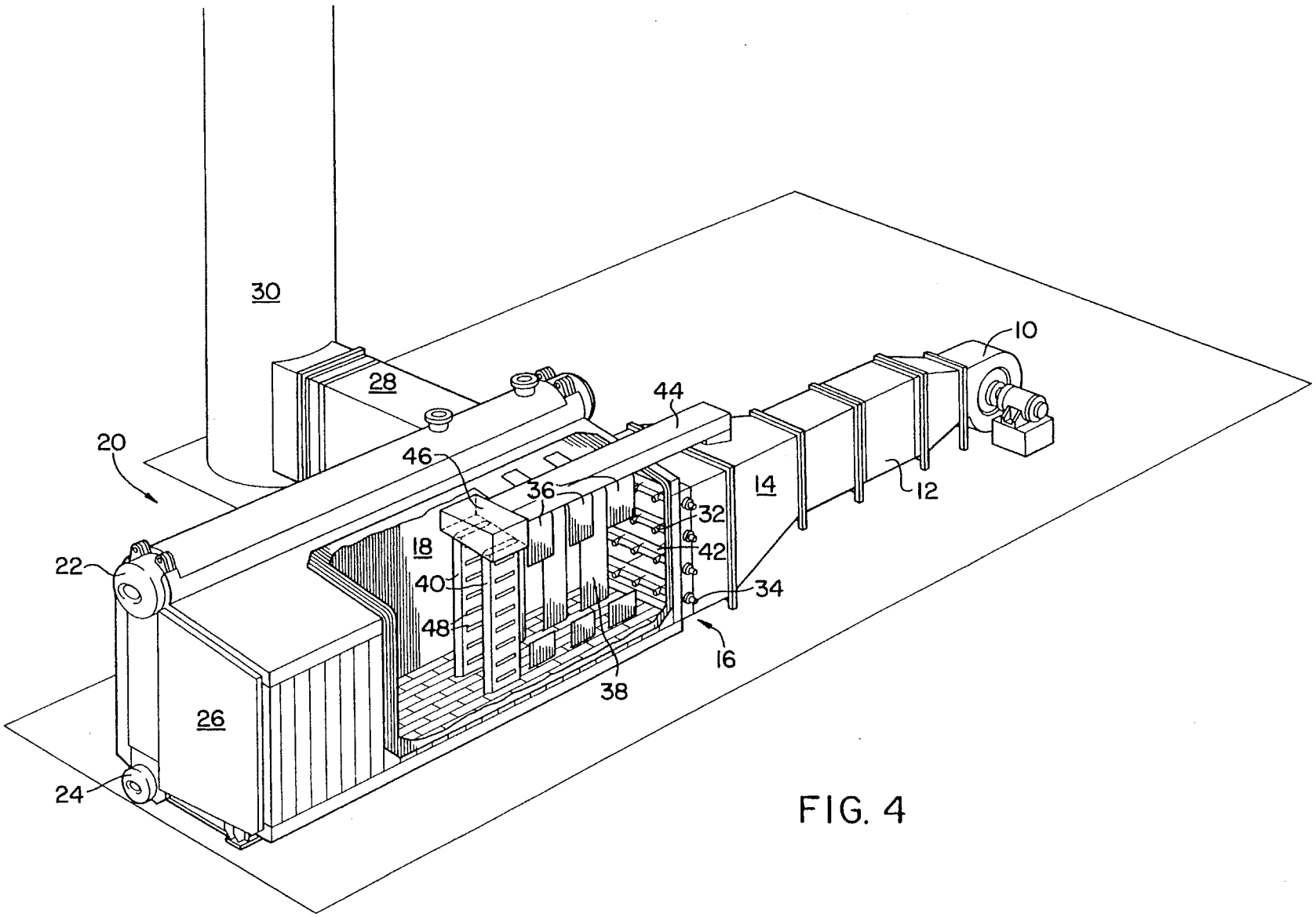
FIG. 4 is a perspective view, partly in section, of a fourth embodiment of the low $NO_x$, integrated boiler-burner apparatus wherein one or more chill tube assemblies and one or more internal air duct assemblies are positioned in the furnace space of the boiler.

The present invention contemplates that a combination of the chill tube assemblies 36 and internal air duct assemblies 40 may be desirable. As shown in FIG. 4, a fourth embodiment of the invention, one or more chill tube assemblies 36 and one or more internal air duct assemblies 40 can be positioned within the furnace space 18. Three pairs of chill tube assemblies 36 arranged in three rows are shown, together with one pair of internal air duct assemblies 40 downstream of the last row of chill tube assemblies 36. However, the invention is not limited to this particular arrangement, and any inter-combination of these elements may be employed.

Figure 5:
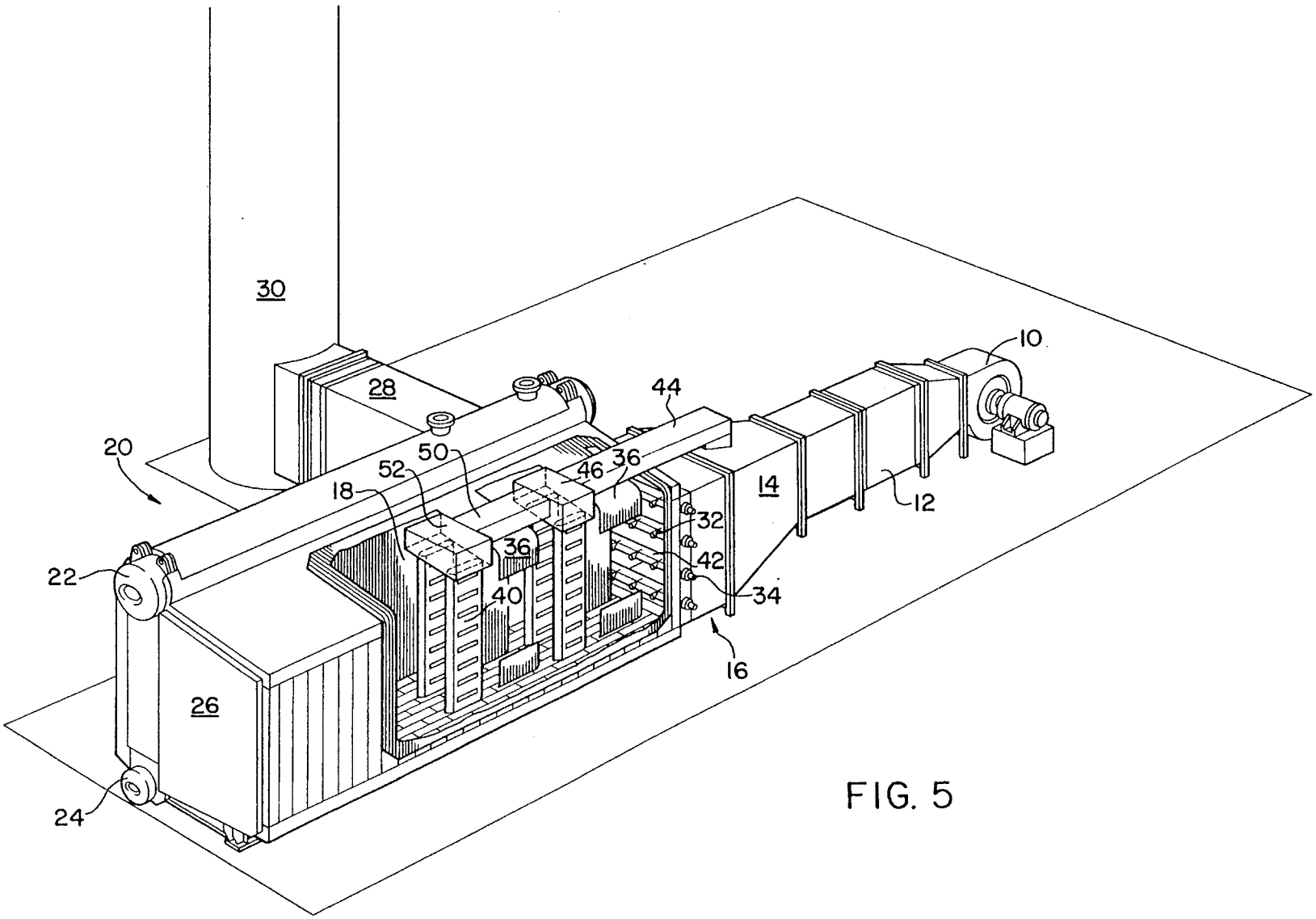
FIG. 5 is a perspective view, partly in section, of fifth embodiment of the low $NO_x$, integrated boiler-burner apparatus wherein one or more chill tube assemblies and one or more internal air duct assemblies are interspersed among each other within the furnace space of the boiler.

One such variation, by way of example and not limitation, is shown in FIG. 5, a fifth embodiment of the invention, wherein one or more chill tube assemblies 36 and one or more internal air duct assemblies 40 are interspersed among each other within the furnace space 18. Again, while two pairs of chill tube assemblies 36 and two pairs of internal air duct assemblies 40 are shown, each type of assembly 36, 40 arranged in two rows and arranged in alternating fashion, other arrangements are possible and within the scope of the invention. The different types of assemblies 36, 40 need not alternate; they need not be equal in number; and one type of assembly can precede the other as desired.

Figure 6:
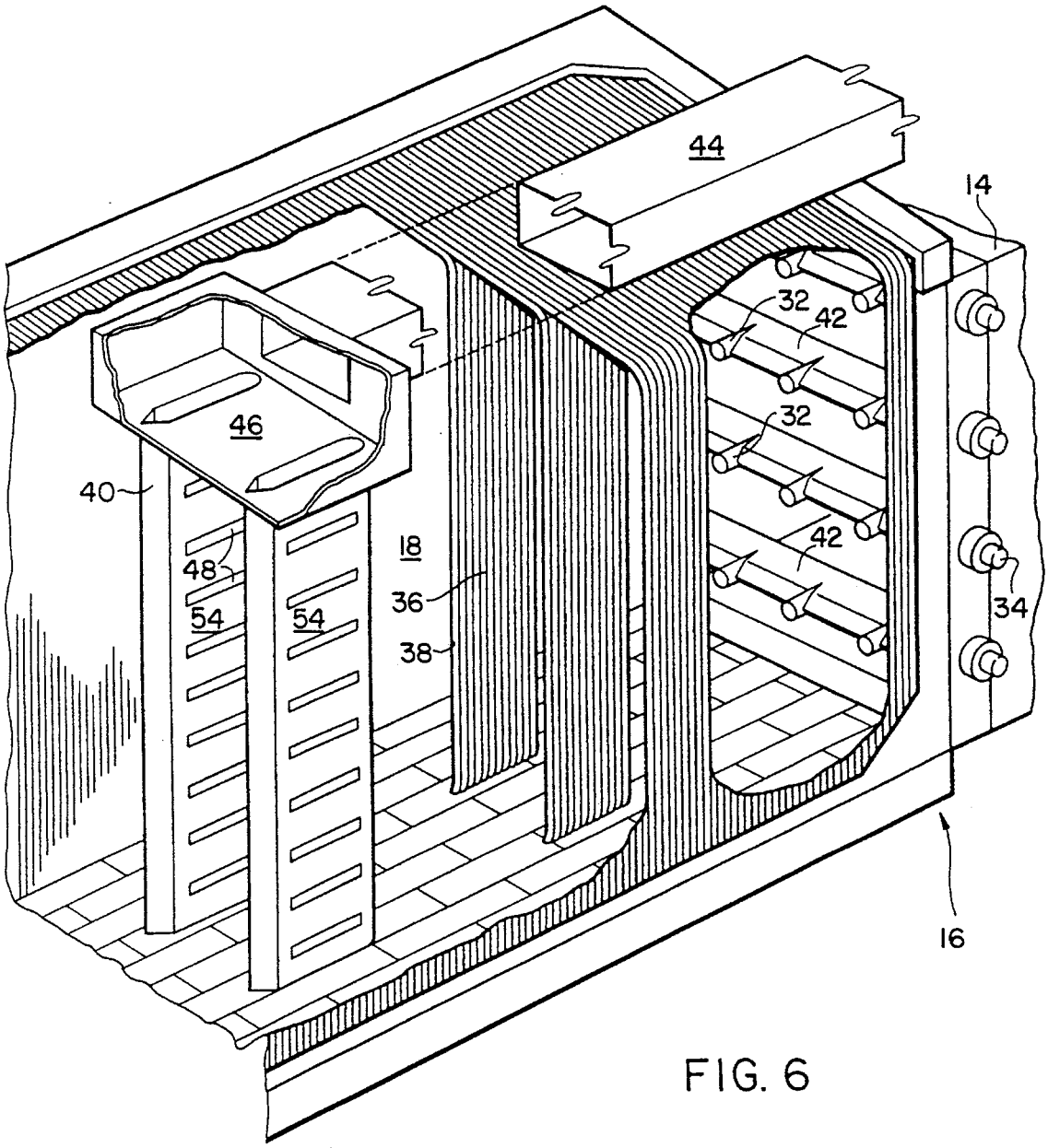
FIG. 6 is a close-up perspective view, partly in section, of the furnace space of the low $NO_x$, integrated boiler-burner apparatus illustrating the placement of one or more chill tube assemblies and one or more internal air duct assemblies therein.

FIG. 6 is a close-up, perspective view, partly in section, of the furnace space 18 of the low $NO_x$, integrated boiler-burner apparatus of the present invention illustrating the placement of one or more chill tube assemblies 36 and one or more internal air duct assemblies 40 therein. It is preferred that the chill tube assemblies 36 precede the internal air duct assemblies 40, in the direction of combustion exhaust gas flow through the furnace space 18, and that they be in-line with each other. In this way, combustion gas temperatures are minimized and combustion is then completed at the downstream air duct assemblies 40. While the means for discharging staging air into the furnace space 18 advantageously comprise the apertures or slots 48 shown, other configurations can also be used. For example, the apertures 48 can take the form of a plurality of circular holes or perforations spaced in any type of pattern and any place along the entire perimeter of walls 54 forming an internal air duct assembly 40.

Figure 7:
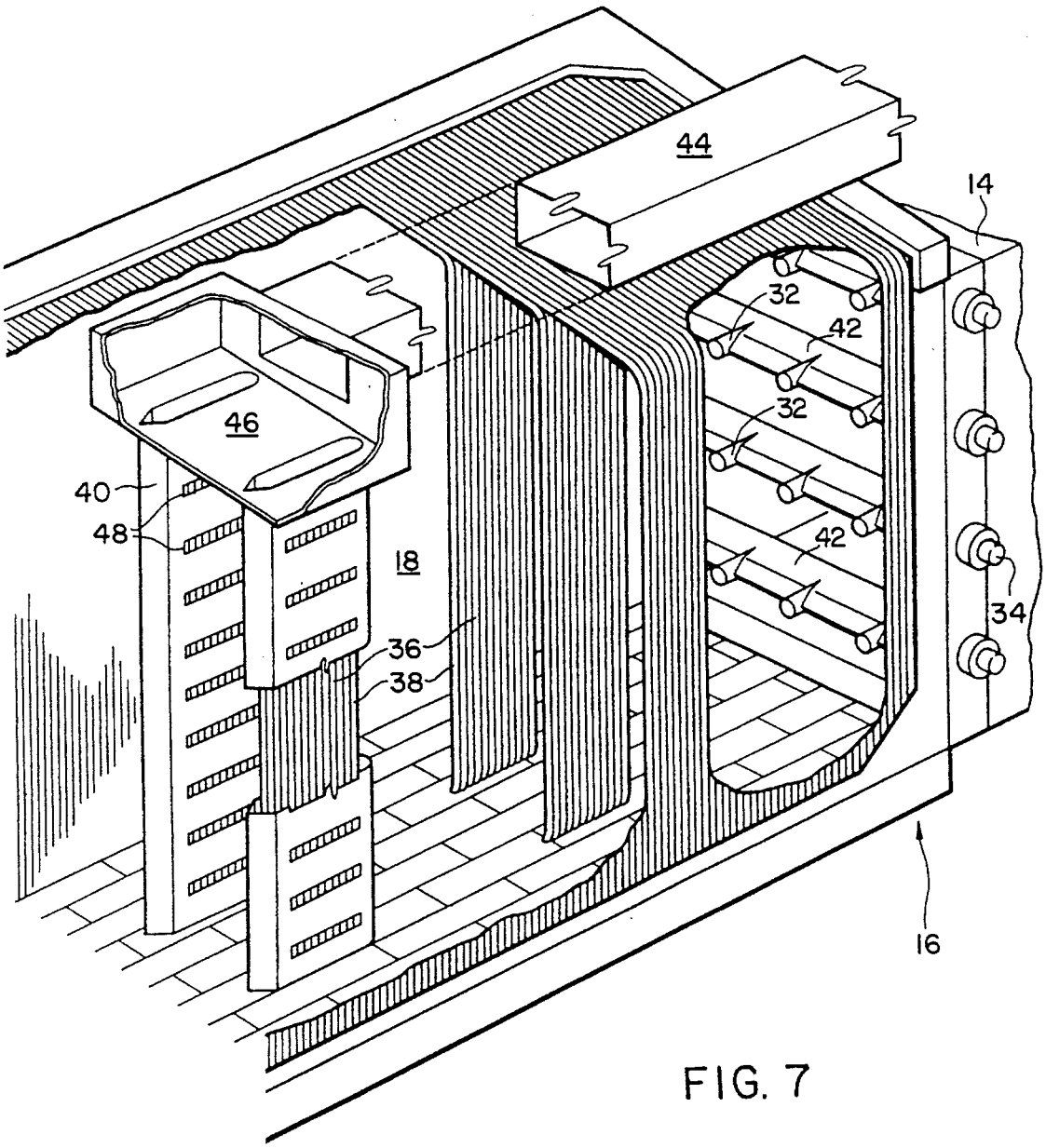
FIG. 7 is a close-up perspective view, partly in section, of the furnace space of the low $NO_x$, integrated boiler-burner apparatus illustrating the placement of one or more chill tube assemblies and one or more internal air duct assemblies wherein some of the one or more chill tube assemblies are positioned within the one or more air duct assemblies.

FIG. 7 is another close-up perspective view, partly in section, of the furnace space 18 of the low $NO_x$, integrated boiler-burner apparatus of the present invention illustrating the placement of one or more chill tube assemblies 36 and one or more internal air duct assemblies 40 therein. In this particular configuration some of the one or more chill tube assemblies 36 are located physically within some of the one or more air duct assemblies 40. Such an arrangement would be particularly advantageous for cooling the assemblies 40 and/or if space limitations in the furnace space 18 prohibit separate locations of the chill tube assemblies 36 and the internal air duct assemblies 40. Again, apertures 48 can take the form of slots, holes or other perforations spaced in any type of pattern at any place along the perimeter of walls 54 forming an internal air duct assembly 40.

Figure 8:
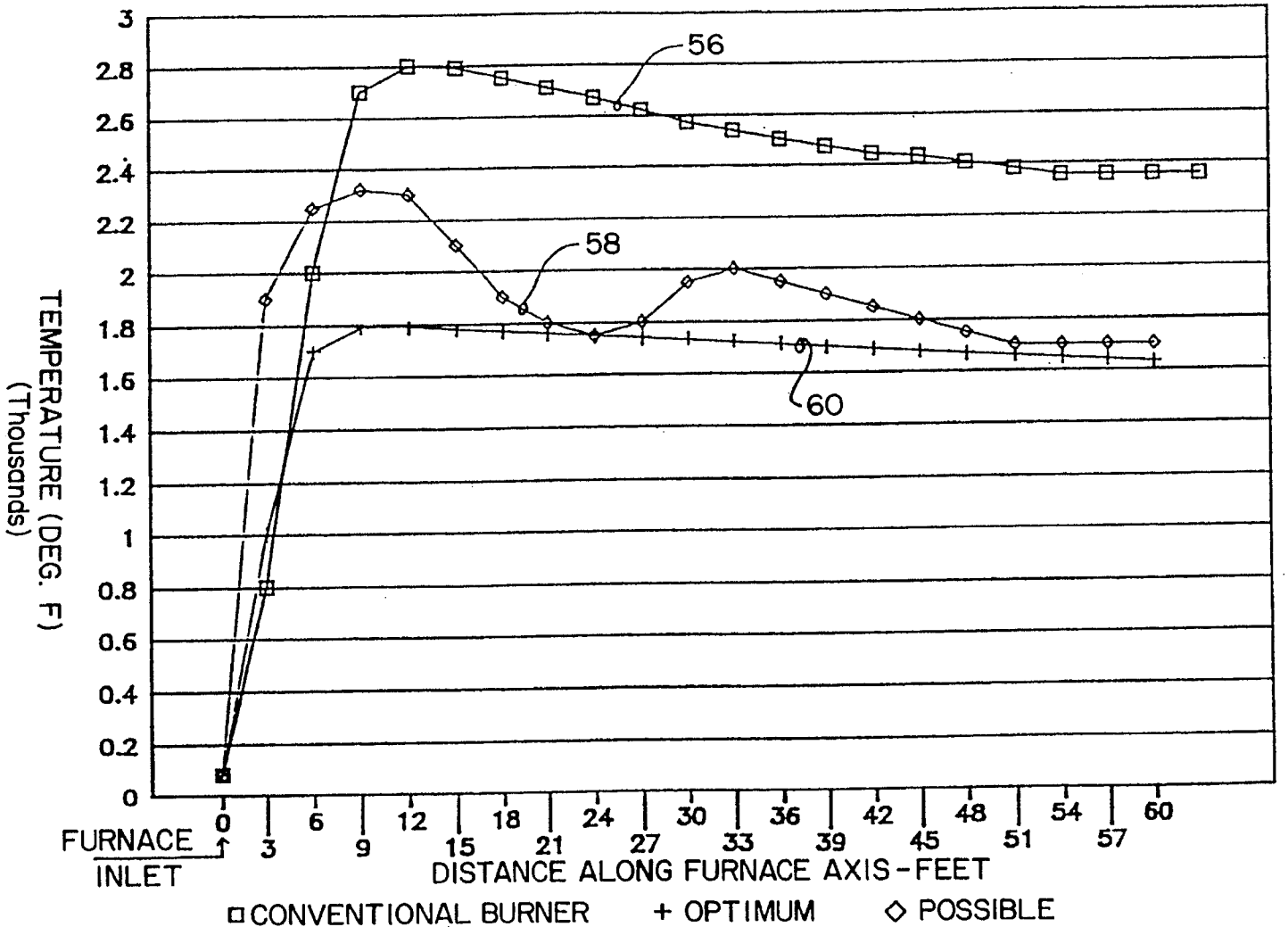
FIG. 8 graphically shows an estimated combustion gas temperature profile versus distance from the furnace space inlet for a conventional burner-boiler arrangement without furnace chill tube or internal air duct assemblies, an optimum temperature profile for $NO_x$ minimization, and a possible profile using the present invention.

FIG. 8 graphically shows an estimated combustion gas temperature profile versus distance from the furnace space 18 inlet for three separate situations. Upper gas temperature profile curve 56 is the estimated variation in combustion gas temperature when a conventional burner and furnace configuration would be employed. Note that the maximum combustion gas temperature is approximately 2800° F., which would produce undesirable levels of $NO_x$. Intermediate or middle gas temperature curve 58 represents an estimated gas temperature profile that is believed to be achievable with the present invention. The maximum combustion gas temperature shown thereon is approximately 2300° F. when the chill tube assemblies 36 are employed. The second peak in the middle gas temperature profile curve 58 is anticipated to occur when additional air staging is provided by a downstream internal air duct assembly 40 to complete combustion, thereby increasing the gas temperature. The lower gas temperature profile curve 60 is a theoretical optimum curve that would be desirable, since the peak combustion gas temperature of approximately 1800° F. would be optimum from a $NO_x$ standpoint.

FIGS. 9–13 disclose, respectively, sixth through tenth embodiments of the low $NO_x$, integrated boiler-burner apparatus. These embodiments are similar to those set forth in FIGS. 1–5, but differ in that each includes a gas recirculation apparatus that is interconnected between the exhaust gas flue 28 and the inlet duct 12 of the boiler-burner apparatus. The gas recirculation apparatus provides recirculating gas to dilute oxygen levels provided to the combustion process. In all of the embodiments set forth in FIGS. 9–13, the additional structure of a gas recirculation flue 62 and its associated gas recirculation fan 64 provides the flow path and gas moving means, respectively, for providing the exhaust gas from the exhaust gas flue 28 back to inlet duct 12. The following description of the embodiments set forth in FIGS. 9–13 parallels that provided earlier in connection with FIGS. 1–5. Similarly, FIGS. 9–13 utilize the chill tube assemblies 36 and internal air duct assemblies 40, and their variations, as described therein and as further disclosed in the configurations set forth in FIGS. 6 and 7.

Figure 9:
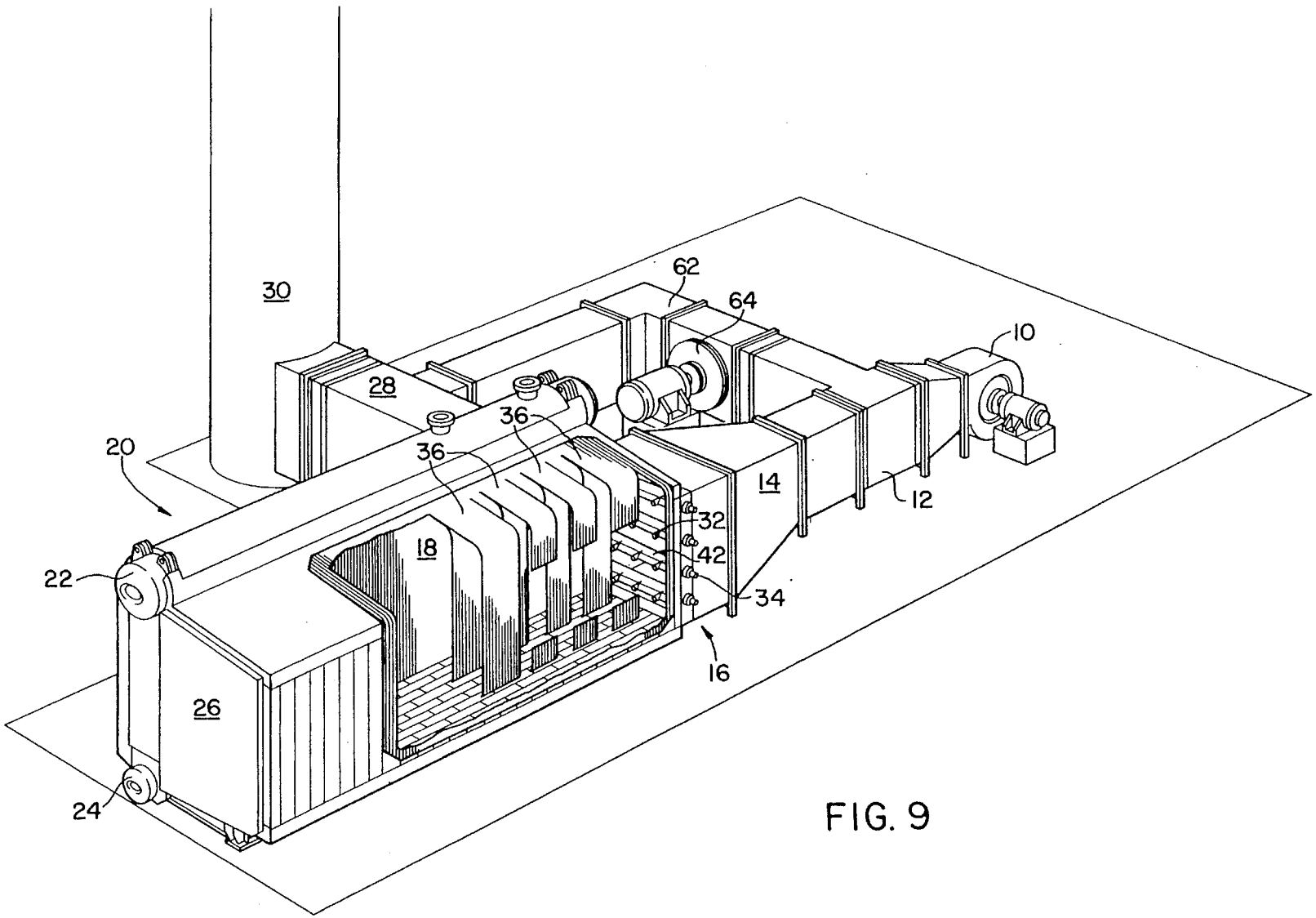
FIG. 9 is a perspective view, partly in section, of a sixth embodiment of the low $NO_x$, integrated boiler-burner apparatus wherein one or more chill tube assemblies are positioned in the furnace space of the boiler and wherein gas recirculation from the outlet of the boiler is provided back to the inlet of the boiler-burner apparatus to dilute oxygen levels provided to the combustion process.

FIG. 9 discloses a sixth embodiment of the low $NO_x$, integrated boiler-burner apparatus wherein one or more chill tube assemblies are positioned within the furnace space 18 of the package boiler 20, in combination with gas recirculation. The one or more chill tube assemblies 36 may be provided, constructed and arranged as described earlier in connection with FIG. 1.

Figure 10:
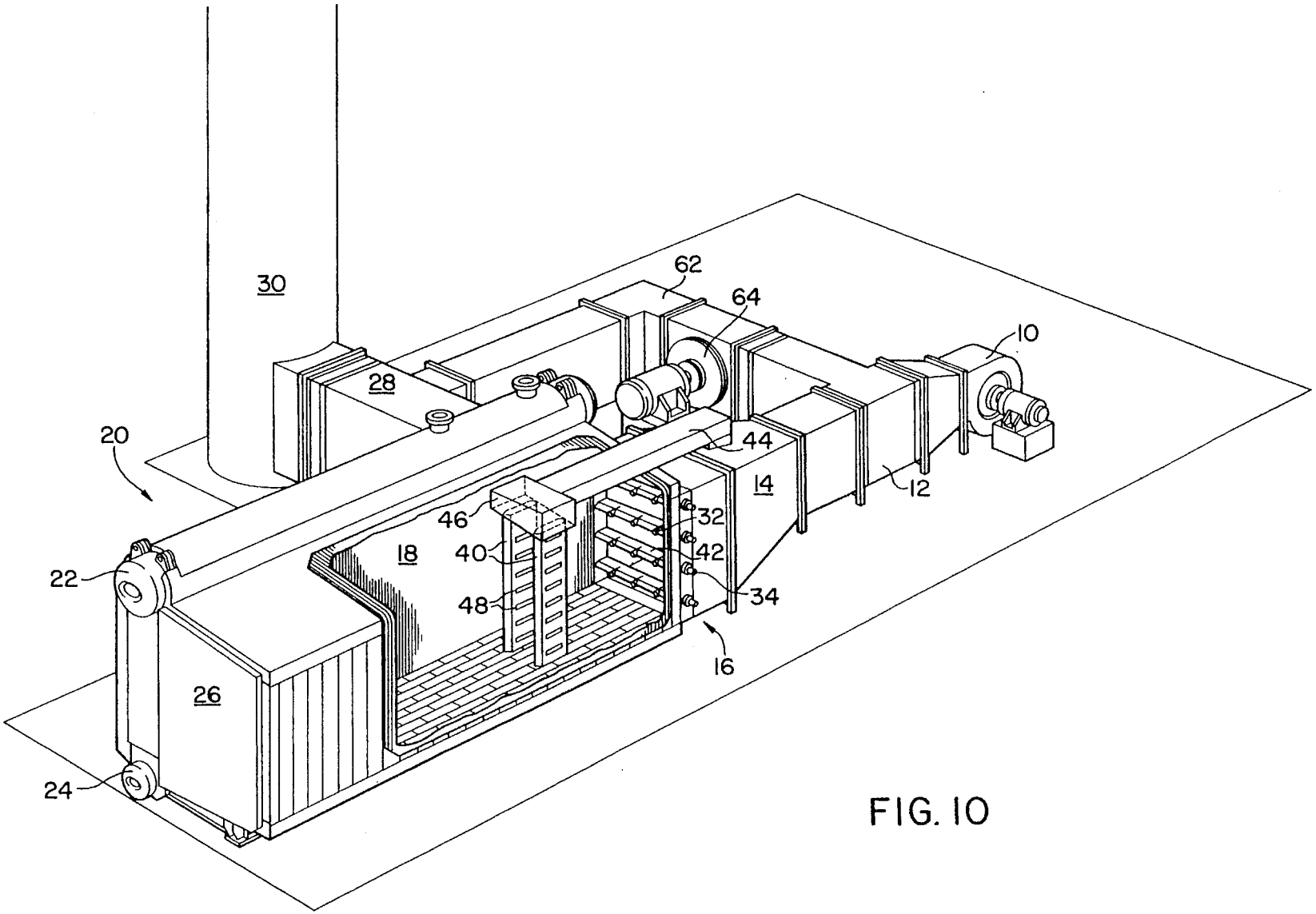
FIG. 10 is a perspective view, partly in section, of a seventh embodiment of the low $NO_x$, integrated boiler-burner apparatus wherein one or more internal air duct assemblies are positioned in the furnace space of the boiler and wherein gas recirculation from the outlet of the boiler is provided back to the inlet of the boiler-burner apparatus to dilute oxygen levels provided to the combustion process.

FIG. 10 discloses a seventh embodiment of the low $NO_x$, integrated boiler-burner apparatus wherein one or more internal air duct assemblies 40 are positioned within the furnace space 18 of the package boiler 20, in combination with gas recirculation. Suitable air staging ducts 44, plenums 46 and dampers and flow measurements devices (not shown) would be provided and constructed as previously described in connection with FIG. 2. The location of these air duct assemblies 40 would similarly be positioned only a portion of the distance into the furnace space 18 from its entrance, approximately ⅓ to ¾ of the furnace depth, with the remaining furnace space 18 downstream being left substantially free of obstructions to allow for final complete burnout of any carbon monoxide.

Figure 11:
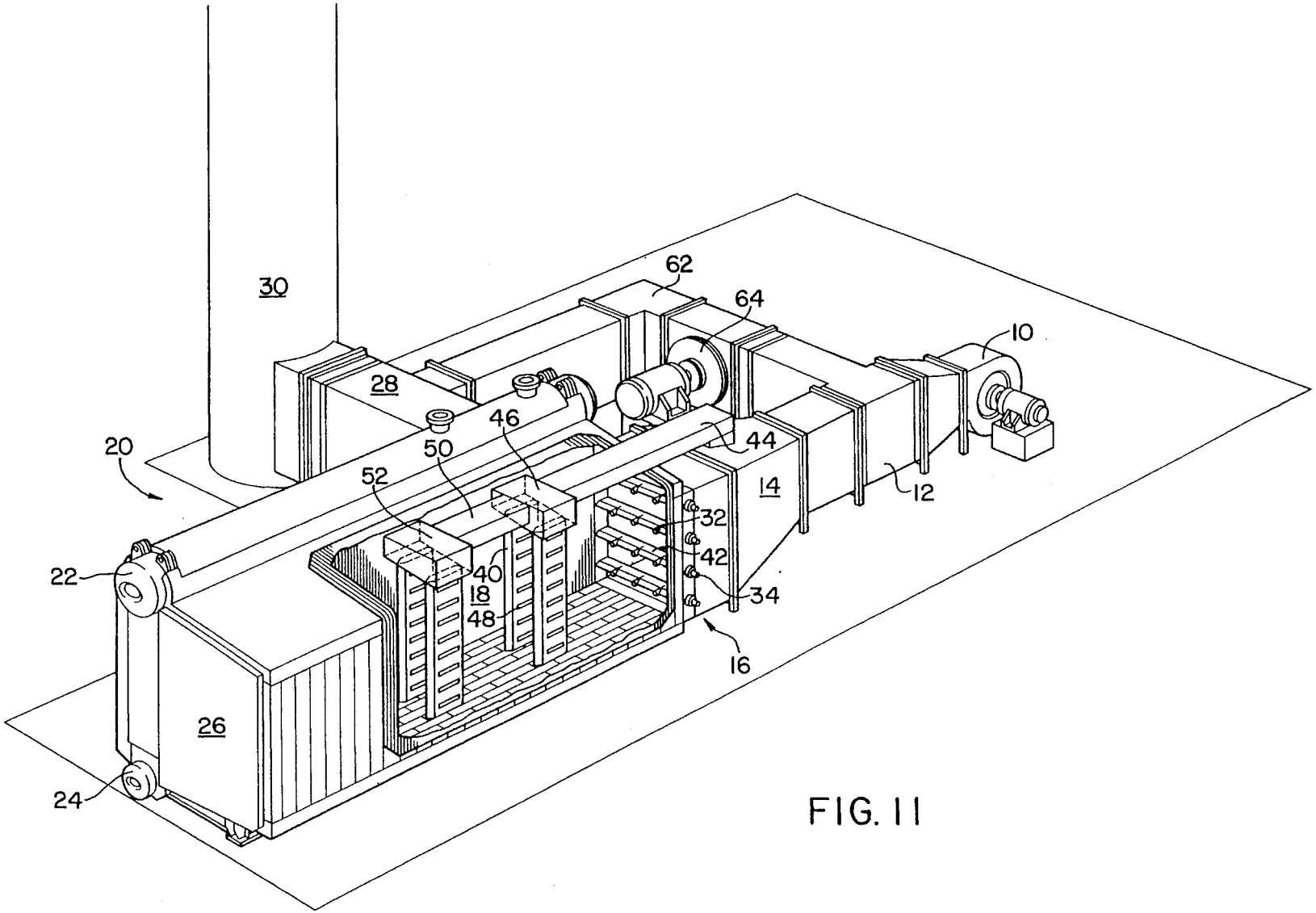
FIG. 11 is a perspective view, partly in section, of an eighth embodiment of the low $NO_x$, integrated boiler-burner apparatus showing an alternative arrangement wherein one or more internal air duct assemblies are positioned at upstream and downstream locations (with respect to a flow of gases through the apparatus) in the furnace space of the boiler and wherein gas recirculation from the outlet of the boiler is provided back to the inlet of the boiler-burner apparatus to dilute oxygen levels provided to the combustion process.

FIG. 11 discloses an eighth embodiment of the low $NO_x$, integrated boiler-burner apparatus showing an alternative arrangement wherein one or more internal air duct assemblies 40 are positioned at upstream and downstream locations within the furnace space 18 of package boiler 20, in combination with gas recirculation. Additional interconnecting staging ducts 50 and air duct plenums 52 would again be provided, together with suitable dampers and air flow measurement devices (not shown).

Figure 12:
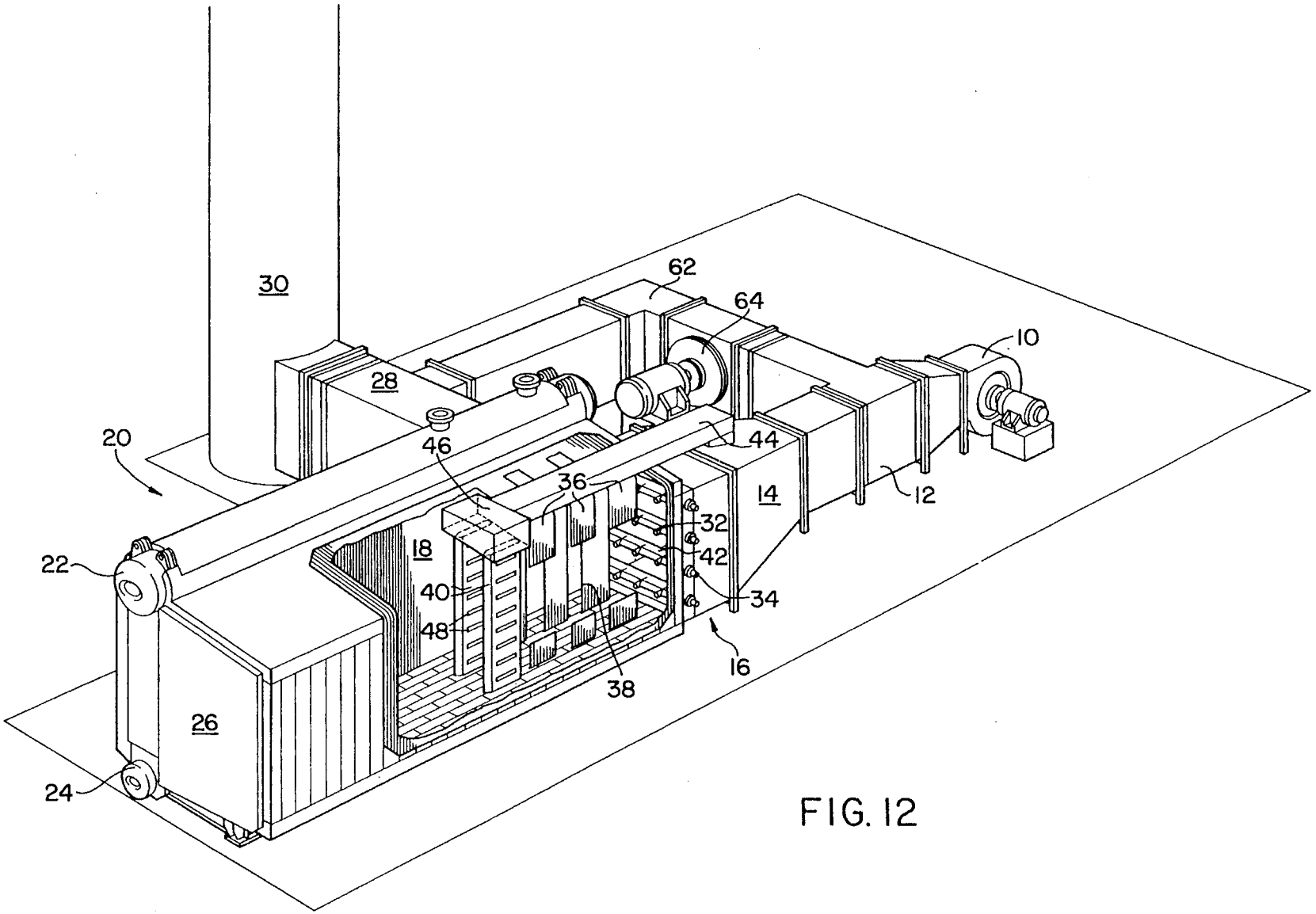
FIG. 12 is a perspective view, partly in section, of a ninth embodiment of the low $NO_x$, integrated boiler-burner apparatus wherein one or more chill tube assemblies and one or more internal air duct assemblies are positioned in the furnace space of the boiler and wherein gas recirculation from the outlet of the boiler is provided back to the inlet of the boiler-burner apparatus to dilute oxygen levels provided to the combustion process.

FIG. 12 discloses a ninth embodiment of the invention showing how one or more chill tube assemblies 36 and one or more internal air duct assemblies 40 can be positioned in the furnace space 18, in combination with gas recirculation. In particular, it will be noted that while three pairs of chill tube assemblies 36 arranged in three rows, together with one pair of internal air duct assemblies 40 downstream of the last row of chill tube assemblies 36 are shown, the invention is not limited to this particular arrangement and any intercombination of these elements may be employed.

Figure 13:
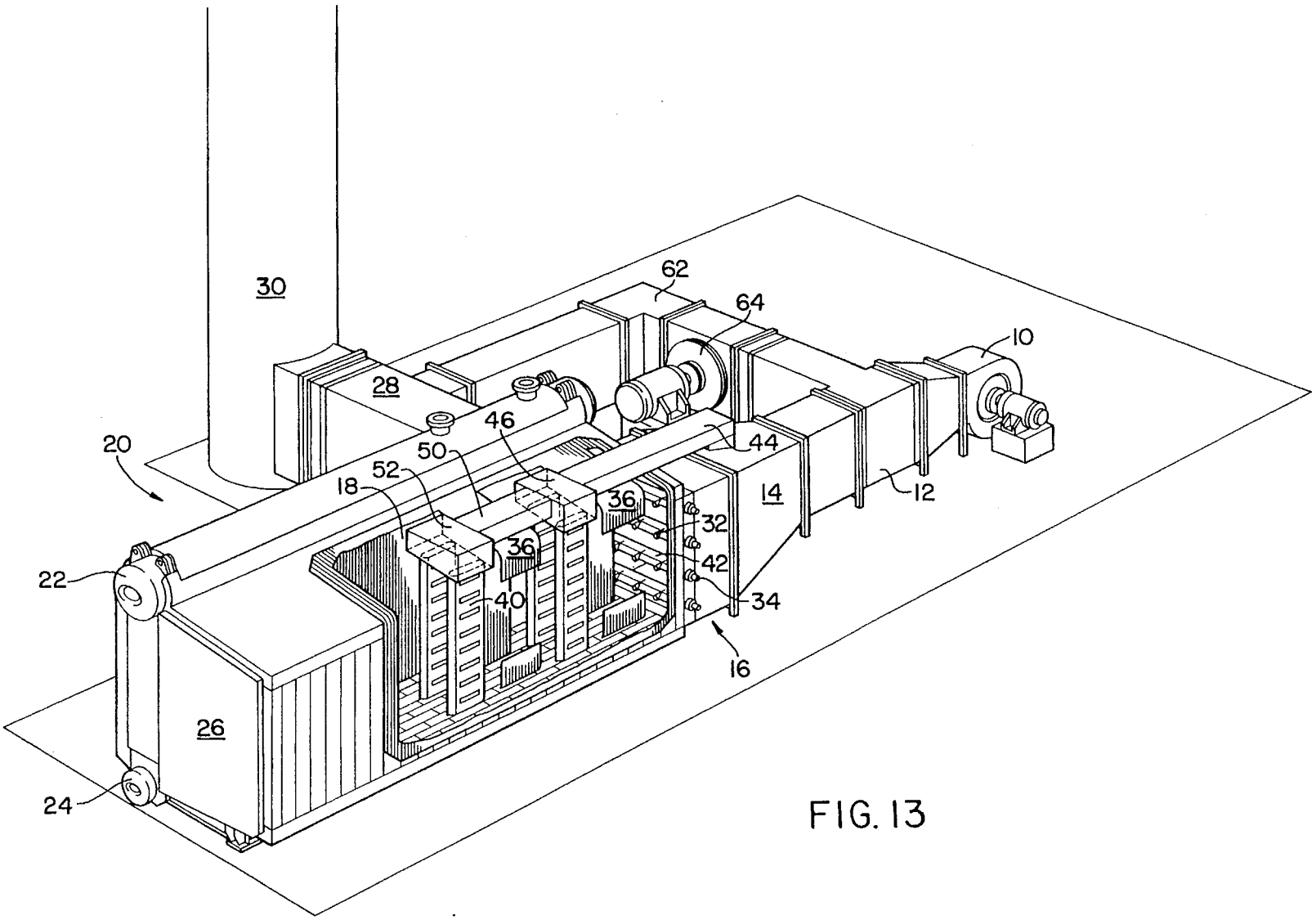
FIG. 13 is a perspective view, partly in section, of a tenth embodiment of the low $NO_x$, integrated boiler-burner apparatus wherein one or more chill tube assemblies and one or more internal air duct assemblies are interspersed among each other within the furnace space of the boiler, and wherein gas recirculation from the outlet of the boiler is provided back to the inlet of the boiler-burner apparatus to dilute oxygen levels provided to the combustion process.

By way of example and not limitation, FIG. 13 discloses a tenth embodiment of the invention, wherein one or more chill tube assemblies 36 and one or more air duct assemblies 40 are interspersed among each other within the furnace space 18, in combination with gas recirculation. While two pairs of chill tube assemblies 36 and two pairs of internal air duct assemblies 40 are shown, each type of assembly 36, 40 arranged in two rows and arranged in alternating fashion, other arrangements are possible and within the scope of the invention. Variations in the types, number and placement of one assembly in front of or behind another can be made as desired.

It will similarly be appreciated that the arrangements of chill tube assemblies 36 and internal air duct assemblies 40 as shown in FIGS. 6 and 7, particularly the arrangement of FIG. 7 wherein some of the one or more chill tube assemblies 36 are located physically within some of the one or more internal air duct assemblies 40, may be employed in any of the embodiments disclosed in FIGS. 9–13.

According to the present invention, $NO_x$ formation is reduced to a minimum while the efficiency and completeness of burning fuel in the furnace space 18 is maximized. The use of gas recirculation as described above further enhances the applicability of the invention to various situations, and re-exposes the exhaust gases to the combustion process, further reducing $NO_x$ emissions.

Accordingly, while specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving factory assembled package boilers, or to the replacement, repair or modification of existing factory assembled package boilers. As clearly exemplified by the numerous examples set forth above, in some embodiments of the invention, certain features of the invention may sometimes be used to advantage without a corresponding use of the other features. Accordingly, all such changes and embodiments properly fall within the scope of the following claims.

I claim:

1. A low $NO_x$, integrated boiler-burner apparatus, comprising:

a horizontally fired, factory assembled package boiler having an inlet plenum and a furnace space;

a multi-nozzle burner (MNB) array including a plurality of vertically and horizontally spaced burner nozzles located at an entrance to the furnace space for supplying fuel for combustion into the furnace space;

one or more vertically extending, horizontally spaced chill tube assemblies located within the furnace space downstream of the MNB array so as to quickly absorb heat from combustion exhaust gases within the furnace space to lower a temperature of the combustion exhaust gases to minimize $NO_x$ formation; and means for supplying fuel to the MNB array.

2. The apparatus according to claim 1, wherein the burner nozzles are distributed in rows and columns, a plurality of air foils extending across the entrance to the furnace space for carrying the burner nozzles.

3. The apparatus according to claim 2, wherein a plurality of horizontally extending and vertically spaced air foils are provided extending across the entrance to the furnace space, each air foil carrying a horizonal row of burner nozzles.

4. The apparatus according to claim 2, wherein a plurality of vertically extending and horizontally spaced air foils are provided across the entrance to the furnace space, each air foil carrying a vertical column of burner nozzles.

5. The apparatus according to claim 1, wherein the burner nozzles are arranged in vertical columns, each vertical column of burner nozzles being positioned such that their flames are centered between the one or more chill tube assemblies to maximize heat transfer between the combustion exhaust gases and the chill tube assemblies and minimize flame impingement thereon.

6. The apparatus according to claim 1, wherein the one or more chill tube assemblies are comprised of fluid conveying tubes for absorbing heat from the combustion exhaust gases within the furnace space.

7. The apparatus according to claim 6, wherein the factory assembled package boiler comprises an upper and lower steam drum, and wherein the fluid conveying tubes are fluidically connected therebetween.

8. The apparatus according to claim 6, wherein each chill tube assembly comprises a plurality of tubes arranged in a single row that extends parallel with a flow of combustion exhaust gases through the furnace space.

9. The apparatus according to claim 1, wherein the one or more chill tube assemblies are arranged within the furnace space in one or more rows, with two or more chill tube assemblies in each row.

10. The apparatus according to claim 1, further comprising means for providing combustion air to the apparatus, and one or more internal air duct assemblies positioned in the furnace space and provided with a plurality of apertures for discharging staging air into the furnace space, beyond the MNB array.

11. The apparatus according to claim 10, wherein the one or more internal air duct assemblies are positioned only a portion of the distance into the furnace space from the entrance, approximately ⅓ to ¾ of the furnace depth, the remaining furnace space downstream being left substantially free of obstructions to allow for final complete burnout of carbon monoxide.

12. The apparatus according to claim 11, further comprising means for providing staging air from the inlet plenum to the one or more internal air duct assemblies.

13. The apparatus according to claim 12, wherein the means for providing staging air comprises an air staging duct and an air duct plenum fluidically interconnected inbetween the inlet plenum and the one or more internal air duct assemblies.

14. The apparatus according to claim 10, wherein the one or more internal air duct assemblies are arranged within the furnace space in one or more rows at upstream and downstream locations, with two or more internal air duct assemblies in each row.

15. The apparatus according to claim 10, wherein the one or more internal air duct assemblies are located within the furnace space downstream of the one or more chill tube assemblies.

16. The apparatus according to claim 10, wherein the one or more internal air duct assemblies and the one or more chill tube assemblies are interspersed among each other within the furnace space.

17. The apparatus according to claim 10, wherein the one or more internal air duct assemblies alternate with the one or more chill tube assemblies within the furnace space.

18. The apparatus according to claim 10, wherein some of the one or more chill tube assemblies are located physically within some of the one or more internal air duct assemblies within the furnace space.

19. The apparatus according to claim 1, wherein the factory assembled package boiler further comprises an exhaust gas flue, a gas recirculation flue connected between the exhaust gas flue and the inlet plenum, and a gas recirculation fan connected into the gas recirculation flue for providing exhaust gas to dilute oxygen levels provided to the combustion process.

20. The apparatus according to claim 1, including a plurality of vertically extending, horizontally spaced chill tube assemblies located within the furnace space immediately downstream of the MNB array.

21. The apparatus according to claim 20, including a plurality of vertically extending, laterally perforated and horizontally spaced internal air duct assemblies located within the furnace space, and an air staging duct interconnected between the inlet plenum and the plurality of internal air duct assemblies for supplying combustion air into the furnace space downstream of the plurality of chill tube assemblies.

22. The apparatus according to claim 21, wherein the factory assembled package boiler further comprises an exhaust gas flue, a gas recirculation flue connected between the exhaust gas flue and the inlet plenum, and a gas recirculation fan connected into the gas recirculation flue for providing exhaust gas to dilute oxygen levels provided to the combustion process.

23. The apparatus according to claim 21, wherein the plurality of internal air duct assemblies and the plurality of chill tube assemblies are interspersed among each other within the furnace space.

24. A low $NO_x$, integrated boiler-burner apparatus, comprising:

a horizontally fired, factory assembled package boiler having an inlet plenum and a furnace space;

a multi-nozzle burner (MNB) array including a plurality of vertically and horizontally spaced burner nozzles located at an entrance to the furnace space for supplying fuel for combustion into the furnace space;

means for providing combustion air to the apparatus;

one or more internal air duct assemblies positioned in the furnace space and provided with a plurality of apertures for discharging staging air into the furnace space, beyond the MNB array; and means for supplying fuel to the MNB array.

25. The apparatus according to claim 24, further comprising one or more vertically extending, horizontally spaced chill tube assemblies located within the furnace space downstream of the MNB array so as to quickly absorb heat from combustion exhaust gases within the furnace space and lower a temperature of the combustion exhaust gases to minimize $NO_x$ formation.

26. The apparatus according to claim 25, wherein the burner nozzles are arranged in vertical columns, each vertical column of burner nozzles being positioned such that their flames are centered between the one or more chill tube assemblies to maximize heat transfer between the combustion exhaust gases and the chill tube assemblies and minimize flame impingement thereon.

27. The apparatus according to claim 26, wherein the one or more chill tube assemblies are arranged within the furnace space in one or more rows, with two or more chill tube assemblies in each row.

28. The apparatus according to claim 24, wherein the one or more internal air duct assemblies are positioned only a portion of the distance into the furnace space from the entrance, approximately ⅓ to ¾ of the furnace depth, the remaining furnace space downstream being left substantially free of obstructions to allow for final complete burnout of carbon monoxide.

29. The apparatus according to claim 27, wherein the one or more internal air duct assemblies are arranged within the furnace space in one or more rows at upstream and downstream locations, with two or more internal air duct assemblies in each row.

30. The apparatus according to claim 29, wherein the one or more internal air duct assemblies and the one or more chill tube assemblies are interspersed among each other within the furnace space.

31. The apparatus according to claim 24, wherein the factory assembled package boiler further comprises an exhaust gas flue, a gas recirculation flue connected between the exhaust gas flue and the inlet plenum, and a gas recirculation fan connected into the gas recirculation flue for providing exhaust gas to dilute oxygen levels provided to the combustion process.

* * * * *